US009448521B2

(12) United States Patent
Shimazu

(10) Patent No.: US 9,448,521 B2
(45) Date of Patent: Sep. 20, 2016

(54) IMAGE FORMING APPARATUS AND CONTROL METHOD

(71) Applicant: KYOCERA Document Solutions Inc., Osaka (JP)

(72) Inventor: Kozo Shimazu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/881,416

(22) Filed: Oct. 13, 2015

(65) Prior Publication Data

US 2016/0124366 A1 May 5, 2016

(30) Foreign Application Priority Data

Oct. 23, 2014 (JP) ..... 2014-216521

(51) Int. Cl.
*G03G 15/00* (2006.01)
*G03G 15/08* (2006.01)

(52) U.S. Cl.
CPC ..... *G03G 15/556* (2013.01); *G03G 15/0879* (2013.01); *G03G 2215/00945* (2013.01); *G03G 2215/0132* (2013.01)

(58) Field of Classification Search
None
See application file for complete search history.

(56) References Cited

U.S. PATENT DOCUMENTS

2007/0053703 A1* 3/2007 Hirayama ..... G03G 15/0855 399/27
2008/0124108 A1* 5/2008 Tokuyama ..... G03G 15/0853 399/62
2008/0212985 A1* 9/2008 Ohashi ..... G03G 15/0862 399/27
2010/0278563 A1* 11/2010 Hatakeyama ..... G03G 15/0877 399/254
2011/0222872 A1* 9/2011 Minamikawa ..... G03G 15/0853 399/27

FOREIGN PATENT DOCUMENTS

JP H05-265271 A 10/1993
JP 2002207357 A * 7/2002

OTHER PUBLICATIONS

JP 2002207357 English translation, Mukai, Jul. 2002.*

* cited by examiner

*Primary Examiner* — David Gray
*Assistant Examiner* — Thomas Giampaolo, II
(74) *Attorney, Agent, or Firm* — Studebaker & Brackett PC

(57) ABSTRACT

An image forming apparatus in which a sheet conveyance speed is changeable includes a development section, a replenishment section, and a control section. The development section performs development with a developer. The replenishment section replenishes the development section with the developer. The control section controls the replenishment section to control an amount of the developer for replenishment of the development section in response to a change of the sheet conveyance speed.

15 Claims, 6 Drawing Sheets

IMAGE FORMING APPARATUS AND CONTROL METHOD

INCORPORATION BY REFERENCE

The present application claims priority under 35 U.S.C. §119 to Japanese Patent Application No. 2014-216521, filed on Oct. 23, 2014. The contents of this application are incorporated herein by reference in their entirety.

BACKGROUND

The present disclosure relates to an image forming apparatus and a control method.

In an example, an image forming apparatus includes a developing device and a driving means. The developing device uses, as a developer, a two-component developer containing a toner and a carrier. The image forming apparatus reduces the speed of driving by the driving means at the time of image fixation and conveys recording paper at a reduced speed in order to improve the quality of color images.

SUMMARY

An image forming apparatus according to a first aspect of the present disclosure is an image forming apparatus in which a sheet conveyance speed is changeable. The image forming apparatus includes a development section, a replenishment section, and a control section. The development section performs development with a developer. The replenishment section replenishes the development section with the developer. The control section controls the replenishment section to control an amount of the developer for replenishment of the development section in response to a change of the sheet conveyance speed.

A control method according to a second aspect of the present disclosure includes: performing, by a development section, development with a developer; replenishing, by a replenishment section, the development section with the developer; changing, by a control section, a sheet conveyance speed; and controlling, by the control section, an amount of the developer for replenishment of the development section in response to a change of the sheet conveyance speed.

DETAILED DESCRIPTION

Figure 1:
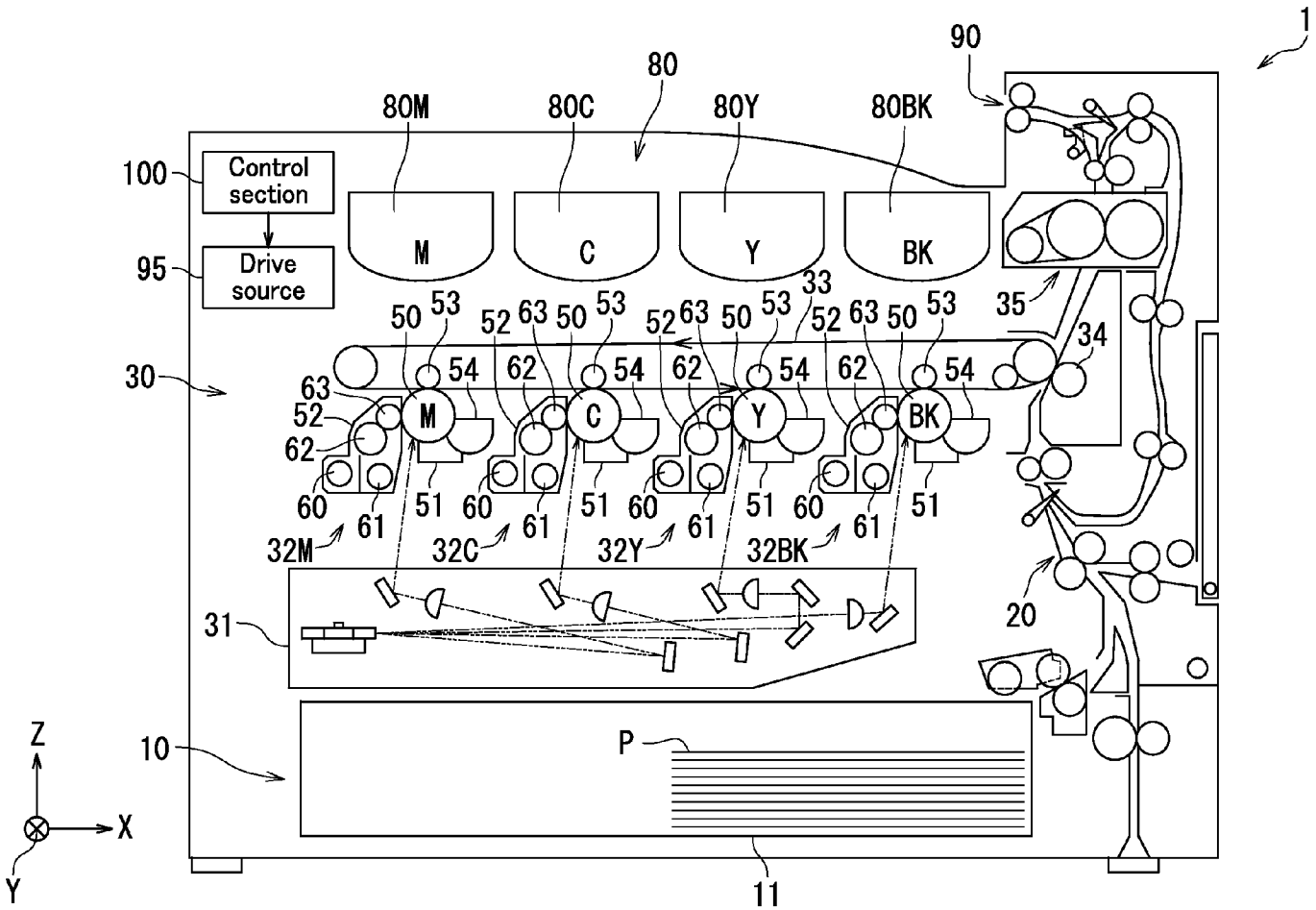
FIG. 1 is a cross-sectional view illustrating an image forming apparatus according to an embodiment of the present disclosure.

Hereinafter, an embodiment of the present disclosure will be described with reference to the accompanying drawings. Elements that are the same or equivalent are indicated in the drawings using the same reference signs and repeated description thereof is omitted. In the present embodiment, an X axis, a Y axis, and a Z axis are perpendicular to one another. The X axis and the Y axis are parallel to a horizontal plane. The Z axis is parallel to a vertical line.

An image forming apparatus 1 according to the embodiment of the present disclosure will be described with reference to FIG. 1. In the present embodiment, the image forming apparatus 1 is a printer. The image forming apparatus 1 includes a sheet feed section 10, a conveyance section 20, an image forming section 30, a developer supplying section 80, a sheet ejecting section 90, a drive source 95, and a control section 100.

The control section 100 controls each element of the image forming apparatus 1 such as the sheet feed section 10, the conveyance section 20, the image forming section 30, the developer supplying section 80, the sheet ejecting section 90, and the drive source 95. For example, the control section 100 includes a storage section and a processor such as a central processing unit (CPU) and/or an application specific integrated circuit (ASIC). The storage section includes a main storage device such as a semiconductor memory and an auxiliary storage device such as a semiconductor memory and/or a hard disk drive.

The sheet feed section 10 includes a cassette 11 in which sheets P are loaded. The sheets P are for example paper sheets or synthetic resin sheets. The sheet feed section 10 feeds a sheet P from the cassette 11 to the conveyance section 20. The conveyance section 20 includes a plurality of conveyance rollers and conveys the sheets P to the image forming section 30. The image forming section 30 forms an image (a color image in the present embodiment) on a sheet P. The conveyance section 20 conveys the sheet P on which the image has been formed to the sheet ejecting section 90. The sheet ejecting section 90 ejects the sheet P out of the image forming apparatus 1.

The image forming section 30 includes a light exposure unit 31, an M unit 32M, a C unit 32C, a Y unit 32Y, a BK unit 32BK, an intermediate transfer belt 33, a secondary transfer roller 34, and a fixing unit 35.

The light exposure unit 31 irradiates each of the M unit 32M, the C unit 32C, the Y unit 32Y, and the BK unit 32BK with light based on image data to form an electrostatic latent image in each of the M unit 32M, the C unit 32C, the Y unit 32Y, and the BK unit 32BK. The M unit 32M forms a magenta developer image based on the electrostatic latent image. The C unit 32C forms a cyan developer image based on the electrostatic latent image. The Y unit 32Y forms a yellow developer image based on the electrostatic latent image. The BK unit 32BK forms a black developer image based on the electrostatic latent image.

The developer images of the four colors are transferred onto an outer surface of the intermediate transfer belt 33 such that the images are superimposed on one another. Thus, a color developer image, that is, a color image is formed. The secondary transfer roller 34 transfers the color image formed on the outer surface of the intermediate transfer belt 33 onto a sheet P. The fixing unit 35 applies heat and pressure onto the sheet P to fix the color image on the sheet P.

Each of the M unit 32M, the C unit 32C, the Y unit 32Y, and the BK unit 32BK includes a photosensitive drum 50, a charger 51, a developing device 52 (development section), a primary transfer roller 53, and a cleaner 54.

The photosensitive drum 50 rotates about its rotational axis. The charger 51 charges a peripheral surface of the corresponding photosensitive drum 50. The light exposure unit 31 irradiates the peripheral surface of the photosensitive drum 50 with light to form an electrostatic latent image thereon. The developing device 52 develops the corresponding electrostatic latent image by attaching a developer to the electrostatic latent image to form a developer image on the peripheral surface of the photosensitive drum 50. That is, the developing device 52 develops the electrostatic latent image with the developer. The primary transfer roller 53 transfers the developer image formed on the peripheral surface of the corresponding photosensitive drum 50 to the outer surface of the intermediate transfer belt 33. The cleaner 54 removes residual developer on the peripheral surface of the corresponding photosensitive drum 50.

The developer supplying section 80 includes a developer container 80M (container) that contains a magenta developer to be supplied to the developing device 52 of the M unit 32M, a developer container 80C (container) that contains a cyan developer to be supplied to the developing device 52 of the C unit 32C, a developer container 80Y (container) that contains a yellow developer to be supplied to the developing device 52 of the Y unit 32Y, and a developer container 80BK (container) that contains a black developer to be supplied to the developing device 52 of the BK unit 32BK.

In the present embodiment, the developer is a two-component developer. That is, the developer contains a toner and a carrier (for example, a magnetic carrier). The developer containers 80M, 80C, 80Y, and 80BK each contain the toner that is a component of the developer.

The drive source 95 is for example a motor that is connected with a plurality of driven sections (for example, the photosensitive drums 50, the developing devices 52, the primary transfer rollers 53, the intermediate transfer belt 33, the secondary transfer roller 34, the fixing unit 35, the sheet feed section 10, the conveyance section 20, and the sheet ejecting section 90) via gears. The drive source 95 drives the plurality of driven sections based on control signals output from the control section 100. More specifically, each of the driven sections is a rotatory body or includes a rotatory body. Rotation of a rotational shaft of the drive source 95 rotates each rotatory body via the gears. The peripheral speed of each rotatory body defines a sheet conveyance speed. The peripheral speed is a rotation speed of a rotatory body at an outermost radial position of the rotatory body.

The control section 100 may change the sheet conveyance speed by changing the rotational speed (that is, the number of rotations per unit time) of the rotational shaft of the drive source 95 and thus changing the peripheral speed of each driven section. That is, the sheet conveyance speed is changeable in the image forming apparatus 1.

In the present embodiment, the image forming apparatus 1 has a normal mode and a reduced speed mode for the sheet conveyance speed. The sheet conveyance speed in the reduced speed mode is lower than the sheet conveyance speed in the normal mode. For example, the sheet conveyance speed in the reduced speed mode is half the sheet conveyance speed in the normal mode. Upon the sheet conveyance speed mode being switched from the normal mode to the reduced speed mode, the control section 100 reduces the rotational speed of the rotational shaft of the drive source 95 to reduce the sheet conveyance speed.

The control section 100 for example switches the sheet conveyance speed mode according to the type of the sheet P, the density of an image to be formed on the sheet P, and the operation mode of the image forming apparatus 1. For example, in a situation in which the sheet P is thick paper and an image having a high density is desired to be formed thereon, or in a situation in which the operation mode of the image forming apparatus 1 is a silent mode, the control section 100 switches the sheet conveyance speed mode from the normal mode to the reduced speed mode to reduce the sheet conveyance speed.

Next, the developing devices 52 will be described with reference to FIGS. 1 and 2. FIG. 2 is a diagram illustrating an internal structure of the developing devices 52. FIG. 2 shows the developing device 52 in the M unit 32M. The developing devices 52 in the C unit 32C, the Y unit 32Y, and the BK unit 32BK have the same structure as the developing device 52 in the M unit 32M, and therefore repeated description will be omitted.

Figure 2:
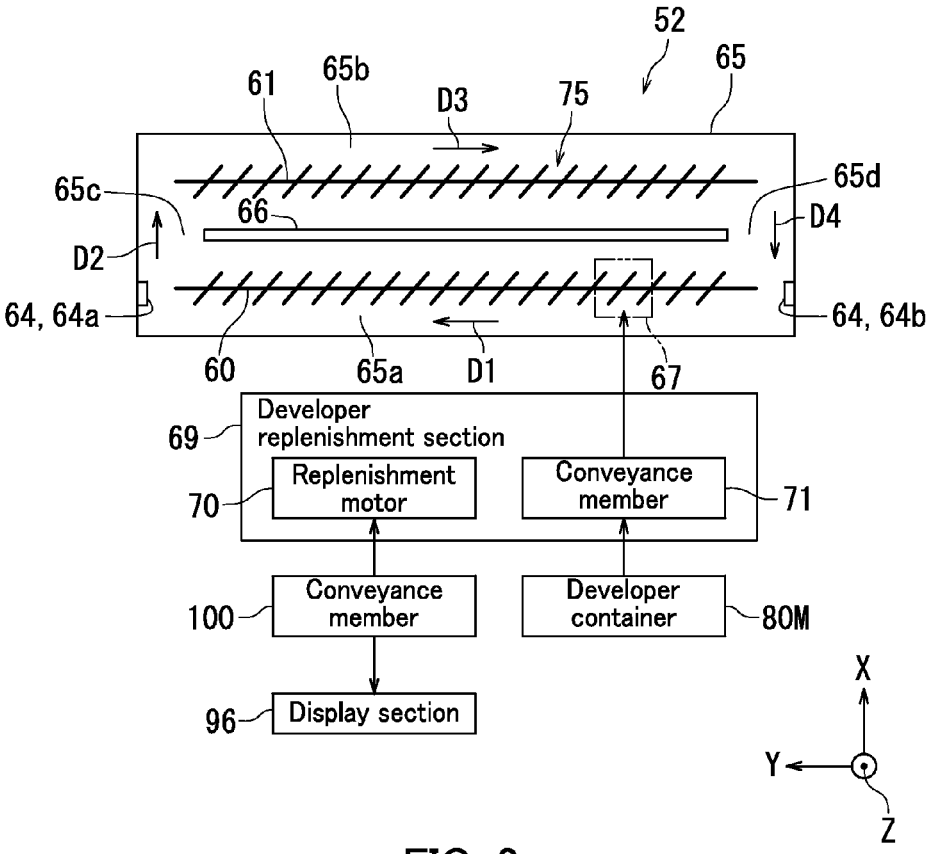
FIG. 2 is a diagram illustrating an internal structure of a developing device in the image forming apparatus according to the embodiment of the present disclosure.

As illustrated in FIG. 1, each of the developing devices 52 includes a first stirring member 60, a second stirring member 61, a magnetic roller 62, and a development roller 63. As illustrated in FIG. 2, the developing device 52 further includes a developer sensor 64 (sensor) and a housing 65. Note that the magnetic roller 62 and the development roller 63 are not shown in FIG. 2 in the interest of ease of illustration.

The housing 65 accommodates the first stirring member 60, the second stirring member 61, the magnetic roller 62, the development roller 63, and the developer sensor 64. The housing 65 also functions as a container for containing the developer. The housing 65 has a partition wall 66. The inner space of the housing 65 is divided by the partition wall 66 into a first stirring chamber 65*a* and a second stirring chamber 65*b*. The inner space of the housing 65 has a path 65*c* and a path 65*d* at opposite ends of the partition wall 66. The first stirring chamber 65*a*, the path 65*c*, the second stirring chamber 65*b*, and the path 65*d* form a developer circulation path 75 in the housing 65.

The first stirring member 60 is disposed in the first stirring chamber 65*a*, and the second stirring member 61 is disposed in the second stirring chamber 65*b*. In the present embodiment, the first stirring member 60 and the second stirring member 61 are screws. The first stirring member 60 and the second stirring member 61 are driven to rotate by the drive source 95. In the present embodiment, the time taken by the first stirring member 60 to make one rotation (that is, a rotation period of the first stirring member 60) is equal to the time taken by the second stirring member 61 to make one rotation (that is, a rotation period of the second stirring member 61).

The developer is stirred and conveyed through the circulation path 75 by the first stirring member 60 and the second stirring member 61 to circulate through the circulation path 75 in circulation directions D1, D2, D3, and D4. As a result, the toner in the developer is charged. The developer is conveyed to the magnetic roller 62 by the second stirring member 61 and attached to the peripheral surface of the photosensitive drum 50 via the development roller 63. As a result, the electrostatic latent image formed on the peripheral surface of the photosensitive drum 50 is developed into a developer image.

The developer sensor 64 detects the amount of the developer contained in the developing device 52, and more specifically the amount of the developer in the circulation path 75. In the present embodiment, the developer sensor 64 is an optical transmissive sensor and includes a light emitting member 64*a* and a light receiving member 64*b* that are opposite to one another. The light emitting member 64*a* is disposed on one of two walls forming the first stirring chamber 65*a*, and the light receiving member 64*b* is disposed on the other of the two walls. The two walls are opposite to one another and intersect with the axis of the first stirring member 60. Each of the light emitting member 64*a* and the light receiving member 64*b* is disposed in the vicinity of an intersection between the axis of the first stirring member 60 and the corresponding wall.

In the present embodiment, a signal output from the light receiving member 64*b* is processed as follows. That is, the rotation period of the first stirring member 60 is divided into equal time intervals, and the signal output from the light receiving member 64*b* is sampled to obtain a plurality of output signal samples corresponding to the respective time intervals. Then, an average value of the output signal samples obtained during the sampling for one rotation period (that is, a specific period of time) of the first stirring member 60 is calculated. The control section 100 processes the average value as a sensor value from the developer sensor 64.

The developer sensor 64 is an optical transmissive sensor. Accordingly, the higher the level of the sensor value is, the smaller the amount of the developer in the circulation path 75 of the developing device 52 is, and the lower the level of the sensor value is, the greater the amount of the developer in the circulation path 75 of the developing device 52 is.

Next, replenishment of the developing device 52 with the developer will be described with reference to FIG. 2. The developing device 52 has a developer replenishment inlet 67. The replenishment inlet 67 is formed in the housing 65 of the developing device 52. The replenishment inlet 67 is located in an upper region of the first stirring chamber 65*a* and upstream of a longitudinal center of the first stirring chamber 65*a* in a developer circulation direction D1 in the first stirring chamber 65*a*.

The image forming apparatus 1 further includes developer replenishment sections 69 (replenishment sections) corresponding to the developer containers 80M, 80C, 80Y, and 80BK, respectively. FIG. 2 shows the developer replenishment section 69 corresponding to the developer container 80M. The developer replenishment sections 69 corresponding to the developer containers 80C, 80Y, and 80BK have the same configuration as the developer replenishment section 69 corresponding to the developer container 80M, and therefore repeated description will be omitted.

The developer replenishment section 69 replenishes the developing device 52 with the developer through the replenishment inlet 67. More specifically, the developer replenishment section 69 includes a replenishment motor 70 and a conveyance member 71. The replenishment motor 70 rotates the conveyance member 71 according to a control signal output from the control section 100. In the present embodiment, the conveyance member 71 is a screw. With the rotation of the conveyance member 71, the developer contained in the developer container 80M is conveyed toward the replenishment inlet 67 and falls into the circulation path 75 through the replenishment inlet 67. Since the developer container 80M contains the toner that is a component of the developer in the present embodiment, the toner to be contained in the developer is supplied to the circulation path 75.

Next, an amount of the developer for replenishment of the developing device 52 will be described with reference to FIG. 2. The control section 100 controls the developer replenishment section 69 to control the amount of the developer for replenishment of the developing device 52 in response to a change of the sheet conveyance speed. For example, the control section 100 controls the developer replenishment section 69 such that the amount of the developer for the replenishment in a predetermined period of time immediately after a change of the sheet conveyance speed is different from the amount of the developer for the replenishment in a period of time after the lapse of the predetermined period of time. Since the amount of the developer for the replenishment is controlled in response to a change of the sheet conveyance speed in the present embodiment, influences of behavior change of the developer due to the change of the sheet conveyance speed can be reduced.

Hereinafter, in the present embodiment, the control section 100 controls the developer replenishment section 69 to control the amount of the developer for replenishment of the developing device 52 in response to a reduction of the sheet conveyance speed, that is, in response to a switch from the normal mode to the reduced speed mode.

For example, the control section 100 controls the developer replenishment section 69 such that the amount of the developer for the replenishment in a predetermined period of time immediately after a reduction of the sheet conveyance speed (may be referred to as a "replenishment amount control period") is different from the amount of the developer for the replenishment in a period of time after a lapse of the predetermined period of time (may be referred to as a "subsequent period").

More specifically, the control is performed as follows. The control section 100 controls the developer replenishment section 69 such that the amount of the developer for the replenishment when a condition for initiation of the replenishment with the developer is satisfied in the replenishment amount control period is smaller than the amount of the developer for the replenishment when a condition for initiation of the replenishment with the developer is satisfied in the subsequent period. In order to reduce the amount of the developer for the replenishment, for example, the control section 100 reduces the amount of the developer for the replenishment per unit time without changing a time spent on the replenishment with the developer or reduces the time spent on the replenishment with the developer without changing the amount of the developer for the replenishment per unit time. More specifically, the control section 100 reduces the amount of the developer for the replenishment or reduce the time spent on the replenishment with the developer by reducing the rotational speed of a rotational shaft of the replenishment motor 70 (that is, the number of rotations of the rotational shaft per unit time), by reducing the time during which the rotational shaft of the replenishment motor 70 is rotated (that is, the time during which the replenishment motor 70 is on), or by reducing a cycle number in intermittent driving of the replenishment motor 70 (that is, the number of cycles each including a time during which the replenishment motor 70 is on and a time during which the replenishment motor 70 is off).

The control section 100 determines that the condition for initiation of the replenishment with the developer is satisfied when the amount of the developer detected by the developer sensor 64 is equal to or smaller than a threshold and then initiates the replenishment with the developer.

Alternatively, the following control may be performed. The control section 100 controls the developer replenishment section 69 to prohibit the replenishment with the developer during the time when a condition for prohibition of the replenishment with the developer predetermined for the replenishment amount control period is satisfied in the replenishment amount control period. In this case, for example, the control section 100 controls the developer replenishment section 69 to prohibit the replenishment with the developer during the time when the amount of the developer detected by the developer sensor 64 is greater than a threshold predetermined for the replenishment amount control period or to prohibit the replenishment with the developer during the replenishment amount control period. More specifically, the control section 100 causes prohibition of the replenishment with the developer by not driving the replenishment motor 70.

The control section 100 determines that the condition for prohibition of the replenishment with the developer is satisfied when the amount of the developer detected by the developer sensor 64 is greater than the threshold predetermined for the replenishment amount control period, and then prohibits the replenishment with the developer.

According to the present embodiment, as described with reference to FIG. 2, the amount of the developer for the replenishment is controlled in response to a reduction of the sheet conveyance speed. As a result, influences of behavior change of the developer due to the reduction of the sheet conveyance speed can be reduced. For example, an image defect, which is a failure to form a satisfactory image on a sheet P, and a detection defect, which is a failure to appropriately detect the amount of the developer in the developing device 52, can be prevented.

Figure 3:
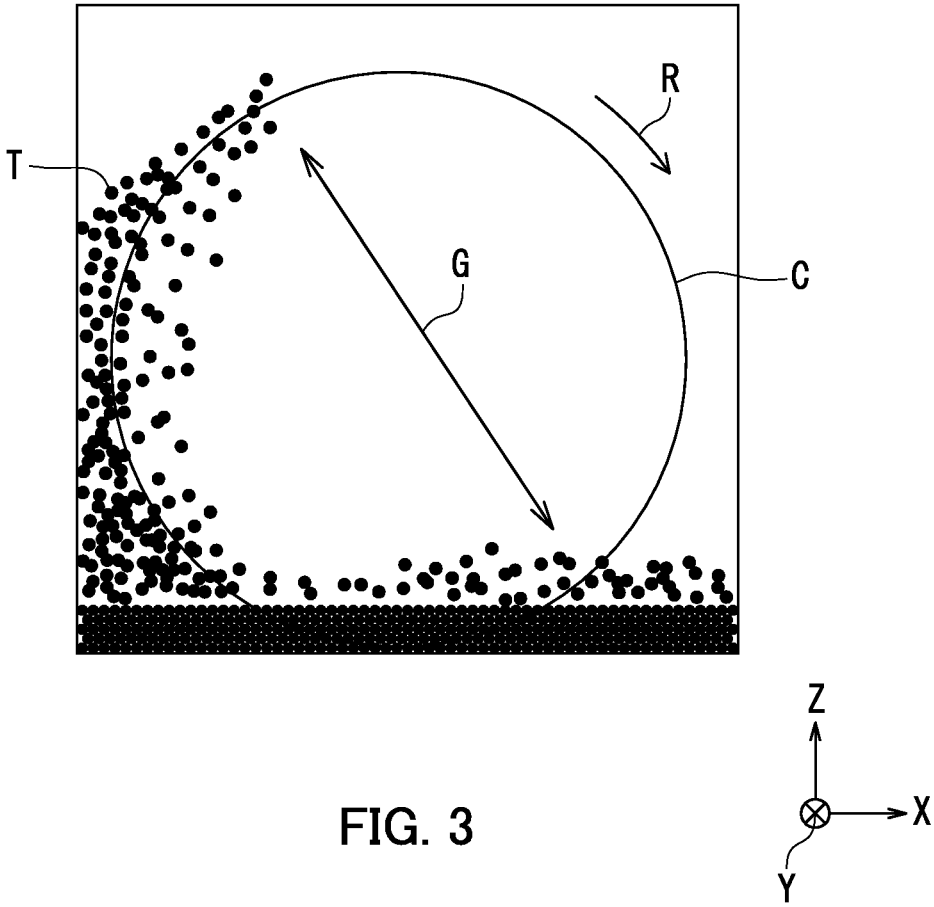
FIG. 3 is a diagram illustrating behavior change of developer due to a reduction of sheet conveyance speed in the image forming apparatus according to the embodiment of the present disclosure.

Next, behavior change of the developer due to a reduction of the sheet conveyance speed and a reason why an image defect can be prevented will be described with reference to FIGS. 2 and 3. FIG. 3 is a diagram illustrating behavior change of the developer, referring to a developer T in the first stirring chamber 65*a* immediately after a reduction of the sheet conveyance speed. Although not shown in FIG. 3 in the interest of ease of illustration, the first stirring member 60 is rotating in the rotation direction R.

Ideally, it is preferable to stir the developer T such that a trajectory of the stirred developer T is in a shape of a circle C. However, a reduction of the sheet conveyance speed, that is, a reduction of the rotational speed of the rotational shaft of the drive source 95 results in a reduction of the rotational speed of the first stirring member 60 (that is, the number of rotations of the first stirring member 60 per unit time) driven by the drive source 95 and a reduction of the rotational speed of the second stirring member 61 (that is, the number of rotations of the second stirring member 61 per unit time) driven by the drive source 95. Accordingly, the behavior of the developer T may be temporarily unstable immediately after the reduction of the sheet conveyance speed.

For example, the developer T may temporarily fail to be circulated smoothly in the circulation directions D1, D2, D3, and D4 or the trajectory of the stirred developer T in the shape of the circle C may temporarily have a relatively large cut out (that is, temporarily have a relatively large void G) immediately after the sheet conveyance speed is reduced, and the rotational speed of the first stirring member 60 and the second stirring member 61 is reduced. In addition, the developer conveyance speed is reduced.

In general, a phenomenon described below may occur if developer T is supplied to the first stirring chamber 65*a* through the replenishment inlet 67 during the time when the trajectory of the stirred developer T has the relatively large void G. That is, out of the supplied developer T, the amount of developer T that goes into the void G is greater than the amount of developer T that is conveyed in the circulation direction D1. Furthermore, a backflow phenomenon of the developer T occurs. That is, the developer T in the void G may stay and accumulate under the replenishment inlet 67 and flow in a direction opposite to the circulation direction D1. Since the developer conveyance speed is low, the developer T is particularly likely to stay and accumulate, resulting in the backflow phenomenon of the developer T. Supplying the developer T immediately after a reduction of the sheet conveyance speed therefore further hinders smooth circulation of the developer T in the circulation direction D1. As a result, the toner in the developer T is charged insufficiently, and an image defect, which is a failure to form a satisfactory image on a sheet P, may occur.

In order to solve such a problem, in the present embodiment, the amount of the developer T for replenishment of the developing device 52 is controlled in response to a reduction of the sheet conveyance speed (that is, the replenishment with the developer is prohibited or the amount of the developer T for the replenishment is reduced). Thus, the developer T is prevented from going into the void G and thus prevented from staying and causing the backflow phenomenon. As a result, the developer T can be circulated in the circulation directions D1, D2, D3, and D4 more smoothly when the amount of the developer T for the replenishment is controlled than when not controlled. Since the developer T is circulated smoothly, it is possible to appropriately charge the toner in the developer T and prevent an image defect.

Figure 4:
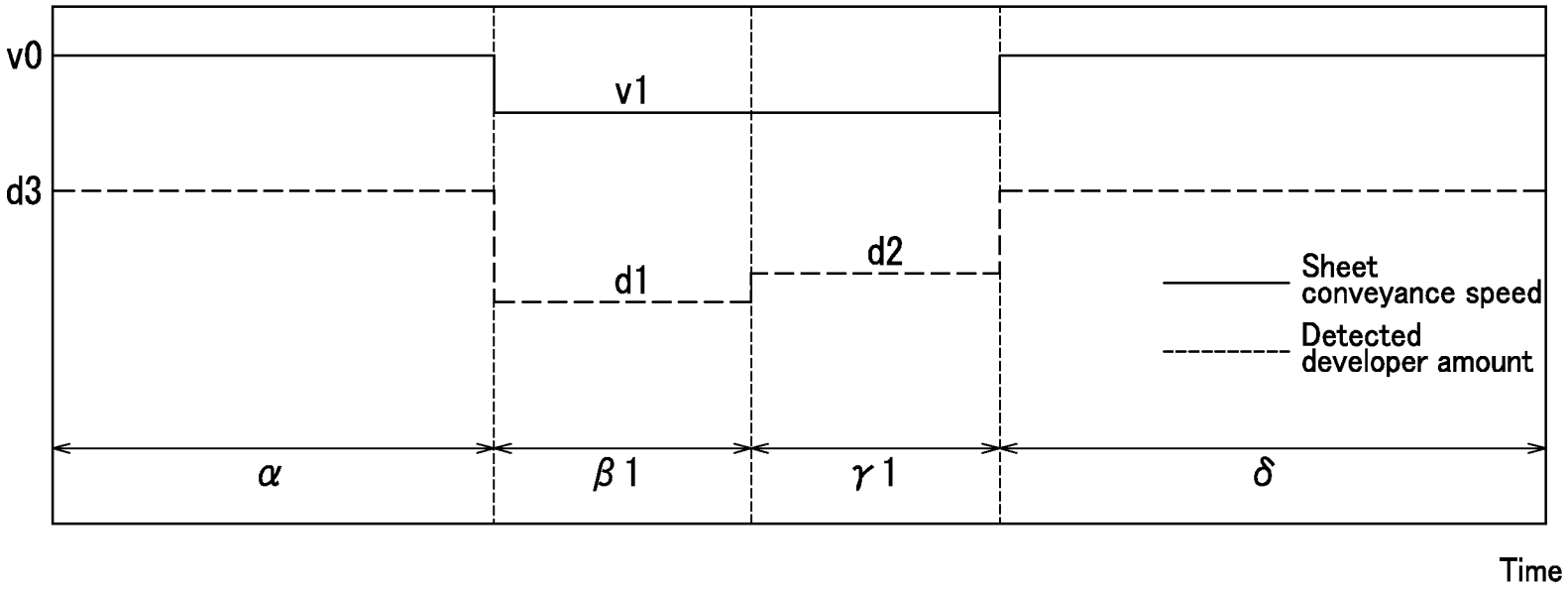
FIG. 4 is a diagram illustrating behavior change of a developer sensor due to a reduction of the sheet conveyance speed in the image forming apparatus according to the embodiment of the present disclosure.

Next, behavior change of the developer sensor 64 due to a reduction of the sheet conveyance speed and a reason why defective detection of the developer can be prevented will be described with reference to FIGS. 2 and 4. FIG. 4 is a diagram illustrating behavior change of the developer sensor 64. The vertical axis represents the sheet conveyance speed or the amount of developer detected by the developer sensor 64 (hereinafter, referred to as a "detected developer amount"). The horizontal axis represents time. In the present embodiment, the detected developer amount is a value obtained by converting a sensor value from the developer sensor 64 into an amount of developer in the circulation path 75 of the developing device 52. A solid line represents the sheet conveyance speed, and a dashed line represents the detected developer amount.

A period $\alpha$ is a period of time during which the sheet conveyance speed mode is the normal mode, that is, a period of time before a reduction of the sheet conveyance speed. An unstable period $\beta$1 during which the developer behavior is unstable is a period of time immediately after the sheet conveyance speed mode is switched from the normal mode to the reduced speed mode, that is, a period of time immediately after the reduction of the sheet conveyance speed. Since the developer behavior in the circulation path 75 is unstable during the unstable period $\beta$1, the developer sensor 64 shows a smaller detected amount in the unstable period $\beta$1 than in a stable period $\gamma$1 during which the developer behavior is stable despite the fact that the amount of developer in the developing device 52 (more specifically, in the circulation path 75) detected by the developer sensor 64 is the same. The stable period $\gamma$1 during which the developer behavior is stable is a period of time that follows the unstable period $\beta$1 when the sheet conveyance speed mode is the reduced speed mode, that is, when the sheet conveyance speed mode remains unchanged from the mode in the unstable period $\beta$1. The developer behavior in the circulation path 75 is stable during the stable period $\gamma$1. A period $\delta$ is a period of time after the sheet conveyance speed mode is switched from the reduced speed mode to the normal mode, that is, after an increase of the sheet conveyance speed.

The actual amount of developer in the circulation path 75 is constant throughout the period α, the unstable period β1, the stable period γ1, and the period δ.

However, once the sheet conveyance speed is reduced from v0 to v1, the detected developer amount drops from d3 to be d1 in the unstable period β1. This is because the unstable period β1 is a period of time immediately after the reduction of the sheet conveyance speed during which the developer behavior is unstable as described with reference to FIG. 3, that is, the developer is not smoothly circulated in the directions D1, D2, D3, and D4 during the unstable period β1, and the trajectory of the stirred developer has the relatively large void G. Since the developer sensor 64 is an optical transmissive sensor, the larger the void G is, the greater the sensor value is and the smaller the detected developer amount is.

In general, if the developer is supplied to the first stirring chamber 65*a* through the replenishment inlet 67 in the unstable period β1 during which the trajectory of the stirred developer has the relatively large void G, the supplied developer may go into the void G and the developer in the void G may stay under the replenishment inlet 67 to cause the backflow phenomenon of the developer as described with reference to FIG. 3. If the developer is supplied in the unstable period β1, therefore, the sensor value and the detected amount output by the developer sensor 64 may be unstable, leading to a detection defect, which is a failure to appropriately detect the amount of the developer.

The control section 100 in the present embodiment therefore controls the amount of developer for replenishment of the developing device 52 (that is, prevents the replenishment with the developer or reduces the amount of developer for the replenishment) during the unstable period β1 in response to the reduction of the sheet conveyance speed. Thus, the developer is prevented from going into the void G and thus prevented from staying and causing the backflow phenomenon. As a result, the sensor value and the detected amount output by the developer sensor 64 are more stable when the amount of developer for the replenishment is controlled than when not. Thus, a detection defect can be prevented.

The detected developer amount increases from d1 to be d2 in the stable period 71, during which the sensor value and the detected amount output by the developer sensor 64 are stable. This is because the developer behavior is stable during the stable period γ1, that is, the developer is smoothly circulated in the circulation directions D1, D2, D3, and D4, and the void G of the trajectory of the stirred developer is smaller during the stable period γ1. Since the developer sensor 64 is an optical transmissive sensor, the smaller the void G is, the smaller the sensor value is and the greater the detected developer amount is.

Once the sheet conveyance speed is increased from v1 to v0, the detected developer amount increases from d2 to be d3 in the period δ. The developer behavior is more stable when the sheet conveyance speed is increased than when the sheet conveyance speed is reduced. That is, the developer is smoothly circulated in the directions D1, D2, D3, and D4, and the trajectory of the stirred developer has a smaller void G. Accordingly, the sensor value and the detected amount output by the developer sensor 64 are stable, the toner is appropriately charged, and a satisfactory image is formed on a sheet P during the period δ even immediately after the acceleration of the sheet conveyance speed.

Figure 5:
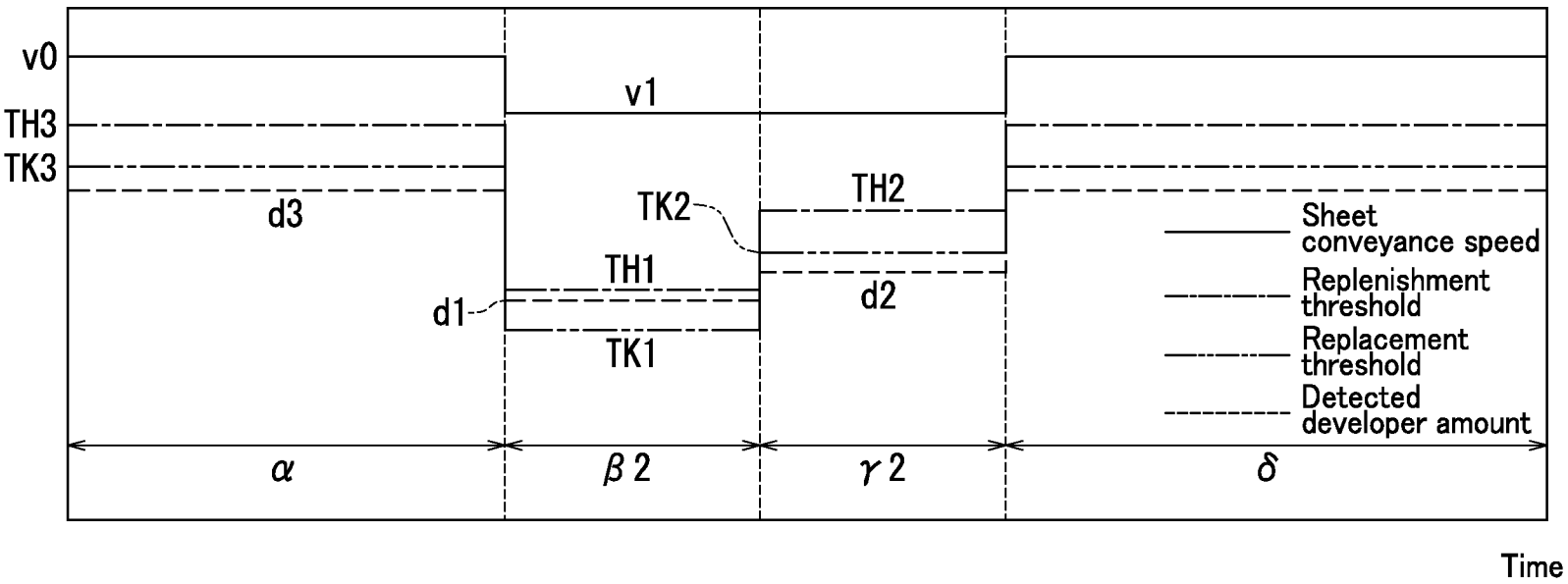
FIG. 5 is a diagram illustrating control of an amount of developer for replenishment based on replenishment thresholds that is performed by the image forming apparatus according to the embodiment of the present disclosure.

Next, control of the amount of developer for the replenishment based on a replenishment threshold will be described with reference to FIGS. 2 and 5. FIG. 5 is a diagram illustrating control of the amount of developer for the replenishment. The vertical axis represents the sheet conveyance speed, a replenishment threshold for determining whether or not replenishment with the developer needs to be performed, a replacement threshold for determining whether or not the developer container 80M needs to be replaced, or the detected developer amount. The horizontal axis represents time. A solid line represents the sheet conveyance speed. A dashed and dotted line represents the replenishment threshold. A dashed and double dotted line represents the replacement threshold. A dashed line represents the detected developer amount. The replacement threshold will be described later with reference to the detected developer amount.

A period α is the same as the period α in FIG. 4. A replenishment amount control period β2 (predetermined period of time) is a period of time immediately after the sheet conveyance speed mode is switched from the normal mode to the reduced speed mode, that is, a period of time immediately after a reduction of the sheet conveyance speed. In the present embodiment, the replenishment amount control period β2 is constant. A subsequent period γ2 (period after the lapse of the predetermined period of time) is a period of time that follows the replenishment amount control period β2 when the sheet conveyance speed mode is the reduced speed mode, that is, when the sheet conveyance speed mode remains unchanged from the mode in the replenishment amount control period β2. A period δ is the same as the period δ in FIG. 4.

The control section 100 has a replenishment threshold TH1 (first replenishment threshold), a replenishment threshold TH2 (second replenishment threshold), and a replenishment threshold TH3 (third replenishment threshold) as the replenishment threshold. The replenishment threshold TH1 is set to a smaller value than the replenishment threshold TH2, so that the replenishment threshold TH1 is harder to satisfy for determining that replenishment with the developer is to be performed than the replenishment threshold TH2. For example, the replenishment threshold TH1 is set based on simulation or measured data to a value at which the developer does not or is less likely to stay or cause the backflow phenomenon in the developing device 52. The replenishment threshold TH2 is set to a smaller value than the replenishment threshold TH3, so that the replenishment threshold TH2 is harder to satisfy for determining that replenishment with the developer is to be performed than the replenishment threshold TH3.

The control section 100 uses the replenishment threshold TH3 during the normal mode. In the period α or in the period δ, therefore, the control section 100 causes the developer replenishment section 69 to replenish the developing device 52 with the developer when the detected developer amount is equal to or smaller than the replenishment threshold TH3. More specifically, in the period α or in the period δ, the control section 100 drives the replenishment motor 70 to replenish the developing device 52 with a specific amount of developer when the detected developer amount is equal to or smaller than the replenishment threshold TH3.

The control section 100 uses the replenishment threshold TH1 in the replenishment amount control period β2. In the replenishment amount control period β2, therefore, the control section 100 causes the developer replenishment section 69 to replenish the developing device 52 with the developer when the detected developer amount is equal to or smaller than the replenishment threshold TH1. More specifically, in the replenishment amount control period β2, the control section 100 drives the replenishment motor 70 to replenish the developing device 52 with a specific amount of developer when the detected developer amount is equal to or smaller than the replenishment threshold TH1.

In the present embodiment, the replenishment amount control period β2 corresponds to the unstable period β1 (FIG. 4). The unstable period β1 can be for example determined based on simulation or measured data. Accordingly, the replenishment amount control period β2 is set so as to correspond to the unstable period β1. The developer sensor 64 shows a smaller detected amount in the replenishment amount control period β2 than in the subsequent period γ2 despite the fact that the amount of developer in the developing device 52 (more specifically, the circulation path 75) detected by the developer sensor 64 is the same. The replenishment amount control period β2 may be set so as to be shorter than the unstable period β1 or longer than the unstable period β1.

The control section 100 uses the replenishment threshold TH2 in the subsequent period γ2. In the subsequent period γ2, therefore, the control section 100 causes the developer replenishment section 69 to replenish the developing device 52 with the developer when the detected developer amount is equal to or smaller than the replenishment threshold TH2. More specifically, in the subsequent period γ2, the control section 100 drives the replenishment motor 70 to replenish the developing device 52 with a specific amount of developer when the detected developer amount is equal to or smaller than the replenishment threshold TH2. In the present embodiment, the subsequent period γ2 corresponds to the stable period γ1 (FIG. 4). The control section 100 may increase the sheet conveyance speed and switch the sheet conveyance speed mode from the reduced speed mode to the normal mode in the replenishment amount control period β2. In this case, the replenishment amount control period β2 is followed by the period δ, skipping the subsequent period γ2.

Since the detected developer amount is smaller in the replenishment amount control period β2 and in the subsequent period γ2 than in the period α and in the period δ, both the replenishment threshold TH1 and the replenishment threshold TH2 are smaller than the replenishment threshold TH3. It is therefore possible to appropriately determine whether or not replenishment with the developer needs to be performed in the replenishment amount control period β2 and in the subsequent period γ2.

Since the detected developer amount is smaller in the replenishment amount control period β2 corresponding to the unstable period β1 than in the subsequent period γ2 corresponding to the stable period γ1, the replenishment threshold TH1 is smaller than the replenishment threshold TH2. It is therefore possible to appropriately determine whether or not replenishment with the developer needs to be performed in the replenishment amount control period β2.

Since the developer behavior is unstable during the replenishment amount control period β2, the replenishment threshold TH1 is smaller than the replenishment threshold TH2. The amount of the developer for the replenishment in the replenishment amount control period β2 immediately after a reduction of the sheet conveyance speed is reduced to be smaller than the amount of the developer for the replenishment in the subsequent period γ2. As a result, influences of behavior change of the developer due to the reduction of the sheet conveyance speed can be reduced.

Next, the replacement threshold for replacement of the developer container 80M and a process using the replacement threshold will be described with reference to FIGS. 2 and 5. The replacement threshold for replacement of each of the developer containers 80C, 80Y, and 80BK is the same as the replacement threshold for replacement of the developer container 80M, and the process using the replacement threshold for replacement of each of the developer containers 80C, 80Y, and 80BK is the same as the process using the replacement threshold of the developer container 80M. Therefore, repeated description will be omitted.

The control section 100 has a replacement threshold TK1 (first replacement threshold), a replacement threshold TK2 (second replacement threshold), and a replacement threshold TK3 (third replacement threshold) as the replacement threshold for replacement of the developer container 80M. The replacement threshold TK1 is set to a smaller value than the replacement threshold TK2, so that the replacement threshold TK1 is harder to satisfy for determining that the developer container 80M is to be replaced than the replacement threshold TK2. The replacement threshold TK2 is set to a smaller value than the replacement threshold TK3, so that the replacement threshold TK2 is harder to satisfy for determining that the developer container 80M is to be replaced than the replacement threshold TK3. The replacement threshold TK1 is smaller than the replenishment threshold TH1. The replacement threshold TK2 is smaller than the replenishment threshold TH2. The replacement threshold TK3 is smaller than the replenishment threshold TH3.

The control section 100 uses the replacement threshold TK3 during the normal mode. In the period α and in the period δ, therefore, the control section 100 determines that the developer container 80M is to be replaced based on the detected developer amount and the replacement threshold TK3. More specifically, in the period α and the period δ, the control section 100 determines that the developer container 80M is to be replaced when the detected developer amount is equal to or smaller than the replacement threshold TK3.

Upon determining that the developer container 80M is to be replaced, the control section 100 notifies a message to a user that prompts the user to replace the developer container 80M. Specifically, the image forming apparatus 1 further includes a display section 96. Upon determining that the developer container 80M is to be replaced, the control section 100 causes the display section 96 to display the message prompting the user to replace the developer container 80M.

The control section 100 uses the replacement threshold TK1 during the replenishment amount control period β2. In the replenishment amount control period β2, therefore, the control section 100 determines that the developer container 80M is to be replaced based on the detected developer amount and the replacement threshold TK1. More specifically, in the replenishment amount control period β2, the control section 100 determines that the developer container 80M is to be replaced when the detected developer amount is equal to or smaller than the replacement threshold TK1. The control section 100 then causes the display section 96 to display the message prompting the user to replace the developer container 80M.

The control section 100 does not reverse the determination to replace the developer container 80M in the replenishment amount control period β2. That is, the control section 100 maintains the determination to replace the developer container 80M during the replenishment amount control period β2 even if the sheet conveyance speed is changed (in the present embodiment, the sheet conveyance speed is reduced) after the developer container 80M is determined to be replaced based on the replacement threshold TK3 in the period α, and as a result the detected developer amount is greater than the replacement threshold TK1. Thus, the determination to replace the developer container 80M can be prevented from being inappropriately reversed.

In an example illustrated in FIG. 5, a detected developer amount d3 is smaller than the replacement threshold TK3 during the period α. Accordingly, the control section 100 determines that the developer container 80M is to be replaced. However, the replacement threshold TK1 that is smaller than the replacement threshold TK3 is used during the replenishment amount control period β2, and therefore a detected developer amount d1 is greater than the replacement threshold TK1. Accordingly, the determination to replace the developer container 80M may be inappropriately reversed. In order to prevent such a problem, the determination to replace the developer container 80M that is made in the period α is maintained during the following replenishment amount control period β2.

The determination to replace the developer container 80M can be prevented from being inappropriately reversed by raising the replacement threshold TK1. However, the raised replacement threshold TK1 accelerates the determination to replace the developer container 80M. As a result, the developer container 80M may be inappropriately determined to be replaced.

In the present embodiment, therefore, it is possible to prevent the determination to replace the developer container 80M from being inappropriately reversed after the developer container 80M is determined to be replaced in the period α by maintaining the determination to replace the developer container 80M in the following replenishment amount control period β2. At the same time, it is possible to appropriately determine whether or not the developer container 80M needs to be replaced in the replenishment amount control period β2 after the developer container 80M is not determined to be replaced in the period α by using the replacement threshold TK1 smaller than the replacement threshold TK2.

Once determining that the developer container 80M is to be replaced, the control section 100 starts counting the number of printed sheets to calculate the number of printable pages. However, if the determination to replace the developer container 80M is reversed after the developer container 80M is determined to be replaced, the count value of the number of the printed sheets is reset. By preventing the determination to replace the developer container 80M from being inappropriately reversed, therefore, it is possible to obtain an accurate number of printable pages.

The control section 100 uses the replacement threshold TK2 during the subsequent period γ in the reduced speed mode. In the subsequent period γ, therefore, the control section 100 determines that the developer container 80M is to be replaced based on the detected developer amount and the replacement threshold TK2. More specifically, in the subsequent period γ2, the control section 100 determines that the developer container 80M is to be replaced when the detected developer amount is equal to or smaller than the replacement threshold TK2. The control section 100 then causes the display section 96 to display a message prompting the user to replace the developer container 80M.

Since the detected developer amount is smaller in the replenishment amount control period β2 and in the subsequent period γ2 than in the period α and in the period 6, both the replacement threshold TK1 and the replacement threshold TK2 are set to a smaller value than the replacement threshold TK3. It is therefore possible to appropriately determine whether or not the developer container 80M needs to be replaced in the replenishment amount control period β2 and in the subsequent period γ2. Since the detected developer amount is smaller in the replenishment amount control period β2 corresponding to the unstable period β1 than in the subsequent period γ2 corresponding to the stable period γ1, the replacement threshold TK1 is set to a smaller value than the replacement threshold TK2. It is therefore possible to appropriately determine whether or not the developer container 80M needs to be replaced in the replenishment amount control period β2.

Figure 6:
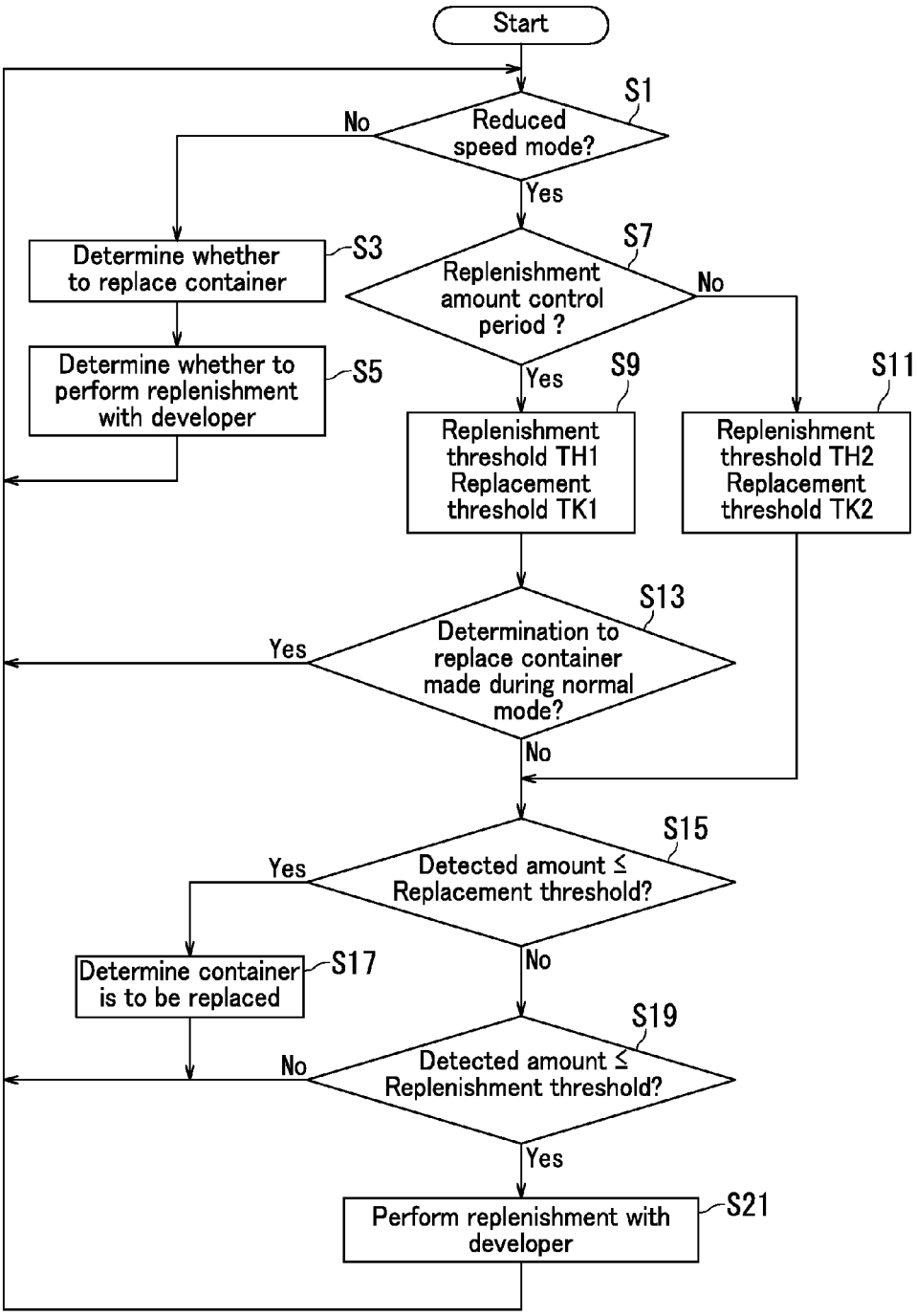
FIG. 6 is a flowchart showing control of a developer replenishment section based on replenishment thresholds that is performed by the image forming apparatus according to the embodiment of the present disclosure.

Next, a method of controlling the developer replenishment section 69 based on the replenishment threshold that is performed by the control section 100 will be described with reference to FIGS. 2, 5, and 6. FIG. 6 is a flowchart showing the method of controlling the developer replenishment section 69 corresponding to the developer container 80M. The method of controlling the developer replenishment section 69 corresponding to each of the developer containers 80C, 80Y, and 80BK is the same as the method of controlling the developer replenishment section 69 corresponding to the developer container 80M, and therefore repeated description will be omitted.

Prior to Step S1, the control section 100 performs a step of changing the sheet conveyance speed in the image forming apparatus 1 (for example, a step of reducing the sheet conveyance speed). Furthermore, a step of developing an electrostatic latent image is performed by the developing device 52 concurrently with the process performed through Steps S1 to S21.

In Step S1, the control section 100 determines whether or not the sheet conveyance speed mode is the reduced speed mode.

When it is determined that the sheet conveyance speed mode is not the reduced speed mode (No in Step S1), that is, when it is determined that the sheet conveyance speed mode is the normal mode, the process proceeds from Step S1 to Step S3.

In Step S3, the control section 100 determines whether or not the developer container 80M needs to be replaced based on the replacement threshold TK3 and performs processing according to a result of the determination.

In Step S5, the control section 100 determines whether or not replenishment with the developer from the developer container 80M needs to be performed based on the replenishment threshold TH3 and performs processing according to a result of the determination. The process then proceeds from Step S5 to Step S1.

When it is determined that the sheet conveyance speed mode is the reduced speed mode (Yes in Step S1), the process proceeds from Step S1 to Step S7.

In Step S7, the control section 100 determines whether or not the current period is the replenishment amount control period β2.

When it is determined that the current period is not the replenishment amount control period β2 (No in Step S7), that is, when it is determined that the current period is the subsequent period γ2, the process proceeds from Step S7 to Step S11.

In Step S11, the control section 100 selects the replenishment threshold TH2 as the replenishment threshold and the replacement threshold TK2 as the replacement threshold. The process then proceeds from Step S11 to Step S15.

When it is determined that the current period is the replenishment amount control period β2 (Yes in Step S7), the process proceeds from Step S7 to Step S9.

In Step S9, the control section 100 selects the replenishment threshold TH1 as the replenishment threshold and the replacement threshold TK1 as the replacement threshold. Step S9 is equivalent to a step of controlling the amount of the developer for replenishment of the developing device 52 in response to a change of the sheet conveyance speed (in the present embodiment, in response to a reduction of the sheet conveyance speed).

In Step S13, the control section 100 determines whether or not the developer container 80M was determined to be replaced during the normal mode.

When the developer container 80M was determined to be replaced during the normal mode (Yes in Step S13), the process proceeds from Step S13 to Step S1. Therefore, in the replenishment amount control period β2 after the developer container 80M was determined to be replaced during the normal mode, the control section 100 does not determine whether or not the developer container 80M needs to be replaced and the determination to replace the developer container 80M is not reversed.

When the developer container 80M was not determined to be replaced during the normal mode (No in Step S13), the process proceeds from Step S13 to Step S15.

In Step S15, the control section 100 determines whether or not the detected developer amount is equal to or smaller than the currently-selected replacement threshold. The currently-selected replacement threshold is either the replacement threshold TK1 selected in Step S9 or the replacement threshold TK2 selected in Step S11.

When it is determined that the detected developer amount is equal to or smaller than the replacement threshold (Yes in Step S15), the process proceeds from Step S15 to Step S17.

In Step S17, the control section 100 determines that the developer container 80M is to be replaced. The process then proceeds from Step S17 to Step S1.

When it is determined that the detected developer amount is not equal to or smaller than the replacement threshold (No in Step S15), that is, when it is determined that the detected developer amount is greater than the replacement threshold, the process proceeds from Step S15 to Step S19.

In Step S19, the control section 100 determines whether or not the detected developer amount is equal to or smaller than the currently-selected replenishment threshold. The currently-selected replenishment threshold is either the replenishment threshold TH1 selected in Step S9 or the replenishment threshold TH2 selected in Step S11.

When it is determined that the detected developer amount is equal to or smaller than the replenishment threshold (Yes in Step S19), the process proceeds from Step S19 to Step S21.

In Step S21, the control section 100 drives the developer replenishment section 69 to replenish the developing device 52 with a specific amount of developer from the developer container 80M. The process then proceeds from Step S21 to Step S1.

When it is determined that the detected developer amount is not equal to or smaller than the replenishment threshold (No in Step S19), that is, when it is determined that the detected developer amount is greater than the replenishment threshold, the process proceeds from Step S19 to Step S1.

According to the image forming apparatus 1 and the control method of the present embodiment, as described above with reference to FIGS. 2, 5, and 6, the replenishment threshold TH1 that is used during the replenishment amount control period β2 is smaller than the replenishment threshold TH2 that is used during the subsequent period γ2, and thus the replenishment with the developer in the replenishment amount control period β2 immediately after a reduction of the sheet conveyance speed is reduced compared to the replenishment with the developer in the subsequent period γ2. As a result, influences of behavior change of the developer due to the reduction of the sheet conveyance speed can be reduced.

According to the present embodiment, as described with reference to FIG. 5, the developer replenishment section 69 is controlled such that during the reduced speed mode, the control of the amount of the developer for the replenishment in the replenishment amount control period β2 corresponding to the unstable period β1 is different from the control of the amount of the developer for the replenishment in the subsequent period γ2 corresponding to the stable period γ1. That is, during the reduced speed mode, the smaller replenishment threshold TH1 is used only during the replenishment amount control period β2 corresponding to the unstable period β1 to reduce the amount of the developer for the replenishment. Thus, the length of the replenishment amount control period β2 can be optimized. In addition, the replenishment threshold TH1 that is used during the replenishment amount control period β2 is set to a smaller value than the replenishment threshold TH2 that is used during the subsequent period γ2 in consideration of the detected developer amount that tends to be smaller in the unstable period β1 than in the stable period γ1, and thus whether or not to perform replenishment with the developer can be appropriately determined.

Furthermore, according to the present embodiment, the replenishment threshold TH2 and the replenishment threshold TH1 that is harder to satisfy for determining that replenishment with the developer is to be performed than the replenishment threshold TH2 are used during the reduced speed mode for the sheet conveyance speed. Accordingly, it is possible to reduce the replenishment with the developer in the replenishment amount control period β2 through simple control by selecting the replenishment threshold TH1 as the replenishment threshold in response to a switch of the sheet conveyance speed mode from the normal mode to the reduced speed mode.

Furthermore, according to the present embodiment, the determination to replace the developer container 80M that is made in the period α can be easily prevented from being inappropriately reversed by maintaining the determination to replace the developer container 80M during the following replenishment amount control period β2. In addition, the replacement threshold TK1 that is used during the replenishment amount control period β2 is set to a smaller value than the replacement threshold TK2 that is used during the subsequent period γ2 in consideration of the detected developer amount that tends to be smaller in the unstable period β1 than in the stable period γ1, and thus whether or not to replace the developer container 80M can be appropriately determined.

Furthermore, according to the present embodiment, the replenishment amount control period β2 is equal in length to the unstable period β1 during which the developer behavior is unstable. As a result, whether or not to perform replenishment with the developer and whether or not to replace the developer containers 80M, 80C, 80Y, and 80BK can be appropriately determined in the unstable period β1 during which the developer behavior is unstable.

So far, the embodiment of the present disclosure has been described with reference to the drawings. However, the present disclosure is not limited to the above embodiment and may be practiced in various forms without deviating from the essence thereof (for example, as explained below in sections (1) to (7)). The drawings schematically illustrate elements of configuration in order to facilitate understanding and properties of elements of configuration illustrated in the drawings, such as thickness, length, and number thereof, may differ from actual properties thereof in order to facilitate preparation of the drawings. Furthermore, properties of elements of configuration described in the above embodiments, such as shapes and dimensions, are merely examples and are not intended as specific limitations. Various alterations may be made so long as there in no substantial deviation from the effects of the present disclosure.

(1) The control section 100 may control the developer replenishment section 69 to control the amount of the developer for replenishment of the developing device 52 in response to an increase of the sheet conveyance speed. For example, the control section 100 may control the developer replenishment section 69 such that the amount of developer for the replenishment in a predetermined period of time immediately after an increase of the sheet conveyance speed (may be referred to as a "replenishment amount control period") is different from the amount of developer for the replenishment in a period of time after a lapse of the predetermined period of time (may be referred to as a "subsequent period"). Specifically, the amount of the developer for the replenishment may be controlled in the same manner as in the control in response to a reduction of the sheet conveyance speed. The replenishment amount control period may be constant or variable. The replenishment amount control period is preferably equal in length to an unstable period during which the developer behavior is unstable but may be shorter or longer than the unstable period.

(2) The control section 100 may vary the replenishment amount control period based on a magnitude of the sheet conveyance speed before a change thereof and a magnitude of the sheet conveyance speed after the change. More specifically, the control section 100 may vary the length of the replenishment amount control period according to a difference between a magnitude of the sheet conveyance speed before the change and a magnitude of the sheet conveyance speed after the change. According to such a configuration, the length of the replenishment amount control period can be further optimized. For example, the control section 100 increases the length of the replenishment amount control period for a larger difference between the sheet conveyance speed before a reduction thereof and the sheet conveyance speed after the reduction (hereinafter, referred to as a "speed difference") and reduces the length of the replenishment amount control period for a smaller speed difference. This is because the larger the speed difference is, the longer the unstable period is, and the smaller the speed difference is, the shorter the unstable period is.

(3) In the present embodiment, the amount of the developer detected by the developer sensor 64 is compared with the replenishment threshold and with the replacement threshold. Alternatively, the output signal or the sensor value from the developer sensor 64 may be compared with the replenishment threshold (the first replenishment threshold, the second replenishment threshold, and the third replenishment threshold) and with the replacement threshold (the first replacement threshold, the second replacement threshold, and the third replacement threshold). The process for comparing the output signal or the sensor value from the developer sensor 64 with the replenishment threshold and with the replacement threshold is substantially the same as the process for comparing the amount of the developer detected by the developer sensor 64 with the replenishment threshold and the replacement threshold.

Since the developer sensor 64 is an optical transmissive sensor in the present embodiment, a greater output signal or a greater sensor value from the developer sensor 64 indicates a smaller amount of developer. In the configuration in which the output signal or the sensor value from the developer sensor 64 is compared with the replenishment threshold and with the replacement threshold, therefore, the replenishment threshold is set to a smaller value than the replacement threshold. Furthermore, during the reduced speed mode for the sheet conveyance speed, the first replenishment threshold that is used during the replenishment amount control period is greater than the second replenishment threshold that is used during the subsequent period, and the first replacement threshold that is used during the replenishment amount control period is greater than the second replacement threshold that is used during the subsequent period. Furthermore, both the first replenishment threshold and the second replenishment threshold are smaller than the third replenishment threshold that is used during the normal mode for the sheet conveyance speed. Both the first replacement threshold and the second replacement threshold are smaller than the third replacement threshold that is used during the normal mode for the sheet conveyance speed.

The following process is performed for comparing the output signal from the developer sensor 64 with the replenishment threshold and with the replacement threshold. The process for comparing the sensor value from the developer 64 is the same as the process for comparing the output signal from the developer sensor 64 with the replenishment threshold and with the replacement threshold, and therefore repeated description will be omitted.

The control section 100 causes the developer replenishment section 69 to replenish the developing device 52 with the developer when the output signal from the developer sensor 64 is equal to or greater than the first replenishment threshold, the second replenishment threshold, or the third replenishment threshold. The control section 100 determines that the developer container 80M is to be replaced when the output signal from the developer sensor 64 is equal to or greater than the first replacement threshold, the second replacement threshold, or the third replacement threshold. The same applies to the developer containers 80C, 80Y, and 80BK.

(4) The developer sensor 64 is not limited to an optical transmissive sensor. For example, the developer sensor 64 may be a magnetic permeability sensor. The magnetic permeability sensor detects the magnetic permeability of the developer in the developing device 52. Then, a mixing ratio between the toner and the magnetic carrier in the developer (that is, the toner concentration) contained in the developing device 52 is obtained based on the magnetic permeability. The higher the toner concentration is, the more the amount of the developer in the developing device 52 is. The lower the toner concentration is, the less the amount of the developer in the developing device 52 is.

(5) In the present embodiment, a two-component developer is used as the developer, and a toner that is a component of the developer is contained in each of the developer containers 80M, 80C, 80Y, and 80BK. Alternatively, both the toner and the carrier may be contained in each of the developer containers 80M, 80C, 80Y, and 80BK, and the developing devices 52 may be replenished with the toner and the carrier from the respective developer containers 80M, 80C, 80Y, and 80BK. The developer is not limited to a two-component developer. For example, the developer contained in each of the developer containers 80M, 80C, 80Y, and 80BK may be a one-component developer consisting of a toner. Furthermore, a single roller for attaching the developer to the corresponding photosensitive drum 50 may be employed instead of the magnetic roller 62 and the development roller 63.

(6) In the present embodiment, the control section 100 has the normal mode and the reduced speed mode for the sheet conveyance speed. Alternatively, the control section 100 may have three or more sheet conveyance speed modes that differ in terms of the sheet conveyance speed.

(7) In the present embodiment, the image forming apparatus 1 is a color printer using developers of four colors. Alternatively, the image forming apparatus 1 may be a color printer using developers of two, three, or five or more colors. Alternatively, the image forming apparatus 1 may be a printer using a developer of a single color. The image forming apparatus 1 is not limited to a printer and may be for example a copier, a facsimile machine, or a multifunction peripheral.

The present disclosure is applicable to the field of image forming apparatuses that form images on sheets.

What is claimed is:

1. An image forming apparatus in which a sheet conveyance speed is changeable, comprising:

a development section configured to perform development with a developer;

a replenishment section having a conveyance member and configured to replenish the development section with the developer contained in a container using the conveyance member; and a control section configured to control the replenishment section to control an amount of the developer that is replenished into the development section in response to a change of the sheet conveyance speed, wherein the development section includes a sensor configured to detect an amount of the developer contained in the development section, the control section has a first replenishment threshold and a second replenishment threshold, in a predetermined period of time immediately after a reduction of the sheet conveyance speed, the control section causes the replenishment section to replenish the development section with the developer when the amount of the developer detected by the sensor is equal to or smaller than the first replenishment threshold, in a subsequent period after a lapse of the predetermined period of time, the control section causes the replenishment section to replenish the development section with the developer when the amount of the developer detected by the sensor is equal to or smaller than the second replenishment threshold, the first replenishment threshold that is used in the predetermined period of time is set to a smaller value than the second replenishment threshold that is used in the subsequent period, so that the first replenishment threshold is harder to satisfy for determining that replenishment with the developer is to be performed than the second replenishment threshold, and a magnitude of the sheet conveyance speed in the predetermined period of time and a magnitude of the sheet conveyance speed in the subsequent period are the same.

2. The image forming apparatus according to claim 1, wherein the control section controls the replenishment section such that the control of the amount of the developer that is replenished in the predetermined period of time is different from the control of the amount of the developer that is replenished in the subsequent period.

3. The image forming apparatus according to claim 1, wherein the control section controls the replenishment section such that the amount of the developer that is replenished when a condition for initiation of the replenishment with the developer is satisfied in the predetermined period of time is smaller than the amount of the developer that is replenished when a condition for initiation of the replenishment with the developer is satisfied in the subsequent period.

4. The image forming apparatus according to claim 1, wherein the control section controls the replenishment section to prohibit the replenishment with the developer during a time when a condition for prohibition of the replenishment with the developer predetermined for the predetermined period of time is satisfied in the predetermined period of time.

5. The image forming apparatus according to claim 4, wherein the control section controls the replenishment section to prohibit the replenishment with the developer during a time when the amount of the developer detected by the sensor is greater than a threshold predetermined for the predetermined period of time or to prohibit the replenishment with the developer during the predetermined period of time.

6. The image forming apparatus according to claim 1, further comprising the container for containing the developer for replenishing the development section, wherein the control section has a first replacement threshold, a second replacement threshold, and a third replacement threshold, in the predetermined period of time, the control section determines that the container is to be replaced based on the first replacement threshold, in the subsequent period, the control section determines that the container is to be replaced based on the second replacement threshold, before the change of the sheet conveyance speed, the control section determines that the container is to be replaced based on the third replacement threshold, and when the sheet conveyance speed is changed after the control section determines that the container is to be replaced based on the third replacement threshold, the control section maintains the determination to replace the container during the predetermined period of time.

7. The image forming apparatus according to claim 1, wherein the control section varies the length of the predetermined period of time according to a difference between a magnitude of the sheet conveyance speed before the change and a magnitude of the sheet conveyance speed after the change.

8. The image forming apparatus according to claim 1, wherein the development section includes a housing for containing the developer and a replenishment inlet for the developer, the housing is divided into a first stirring chamber and a second stirring chamber, and the replenishment inlet is located in an upper region of the first stirring chamber and upstream of a longitudinal center of the first stirring chamber in a developer circulation direction in the first stirring chamber.

9. The image forming apparatus according to claim 8, wherein the development section further includes:

a first stirring member disposed in the first stirring chamber and configured to stir and convey the developer; and a second stirring member disposed in the second stirring chamber and configured to stir and convey the developer, the sensor includes a light emitting member and a light receiving member that are opposite to one another, the light emitting member is disposed on one of two walls forming the first stirring chamber and the light receiving member is disposed on the other of the two walls, and the two walls are opposite to one another and intersect with an axis of the first stirring member.

10. The image forming apparatus according to claim 8, wherein the development section further includes:

a first stirring member disposed in the first stirring chamber and configured to stir and convey the developer; and a second stirring member disposed in the second stirring chamber and configured to stir and convey the developer, the sensor includes a light emitting member and a light receiving member that are opposite to one another, the light emitting member and the light receiving member are each disposed on a different one of two walls forming the first stirring chamber, the two walls are opposite to one another and intersect with an axis of the first stirring member, one of the two walls is located downstream of one longitudinal end of the first stirring member in the developer circulation direction in the first stirring chamber, the other of the two walls is located upstream of the other longitudinal end of the first stirring member in the developer circulation direction in the first stirring chamber.

11. The image forming apparatus according to claim 1, further comprising the container for containing the developer for replenishing the development section, wherein the control section has a first replacement threshold, a second replacement threshold, and a third replacement threshold, in a period of time before the reduction of the sheet conveyance speed, the control section determines that the container is to be replaced when the amount of the developer detected by the sensor is equal to or smaller than the third replacement threshold, in the predetermined period of time, the control section determines that the container is to be replaced when the amount of the developer detected by the sensor is equal to or smaller than the first replacement threshold, in the subsequent period, the control section determines that the container is to be replaced when the amount of the developer detected by the sensor is equal to or smaller than the second replacement threshold, when the sheet conveyance speed is reduced after the control section determines that the container is to be replaced in the period of time before the reduction of the conveyance speed, the control section maintains the determination to replace the container during the predetermined period of time even if the amount of the developer detected by the sensor is greater than the first replacement threshold, the first replacement threshold is set to a smaller value than the second replacement threshold, so that the first replacement threshold is harder to satisfy for determining that the container is to be replaced than the second replacement threshold, the second replacement threshold is set to a smaller value than the third replacement threshold, so that the second replacement threshold is harder to satisfy for determining that the container is to be replaced than the third replacement threshold, the first replacement threshold is smaller than the first replenishment threshold, and the second replacement threshold is smaller than the second replenishment threshold.

12. The image forming apparatus according to claim 11, wherein the control section further has a third replenishment threshold, in the period of time before the reduction of the sheet conveyance speed, the control section causes the replenishment section to replenish the development section with the developer when the amount of the developer detected by the sensor is equal to or smaller than the third replenishment threshold, and the third replacement threshold is smaller than the third replenishment threshold.

13. The image forming apparatus according to claim 11, wherein in the predetermined period of time, the control section:

determines whether or not the amount of the developer detected by the sensor is equal to or smaller than the first replacement threshold when the container is not determined to be replaced in the period of time before the reduction of the sheet conveyance speed;

does not determine whether or not the container needs to be replaced when the container is determined to be replaced in the period of time before the reduction of the sheet conveyance speed;

determines whether or not the amount of the developer detected by the sensor is equal to or smaller than the first replenishment threshold when the container is not determined to be replaced in the predetermined period of time; and does not determine whether or not the replenishment with the developer needs to be performed when the container is determined to be replaced in the predetermined period of time.

14. The image forming apparatus according to claim 1, wherein the control section increases the length of the predetermined period of time for a larger difference between the sheet conveyance speed before the reduction thereof and the sheet conveyance speed after the reduction, and reduces the length of the predetermined period of time for a smaller difference between the sheet conveyance speed before the reduction thereof and the sheet conveyance speed after the reduction.

15. A control method comprising:

performing, by a development section, development with a developer;

replenishing, by a replenishment section, the development section with the developer contained in a container using a conveyance member;

changing, by a control section, a sheet conveyance speed;

controlling, by the control section, an amount of the developer that is replenished into the development section in response to a change of the sheet conveyance speed; and detecting, by a sensor, an amount of the developer contained in the development section, wherein the control section has a first replenishment threshold and a second replenishment threshold, the controlling the amount of the developer that is replenished into the development section includes:

causing, in a predetermined period of time immediately after a reduction of the sheet conveyance speed, the replenishment section to replenish the development section with the developer when the amount of the developer detected by the sensor is equal to or smaller than the first replenishment threshold; and causing, in a subsequent period after a lapse of the predetermined period of time, the replenishment section to replenish the development section with the developer when the amount of the developer detected by the sensor is equal to or smaller than the second replenishment threshold, the first replenishment threshold that is used in the predetermined period of time is set to a smaller value than the second replenishment threshold that is used in the subsequent period, so that the first replenishment threshold is harder to satisfy for determining that replenishment with the developer is to be performed than the second replenishment threshold, and a magnitude of the sheet conveyance speed in the predetermined period of time and a magnitude of the sheet conveyance speed in the subsequent period are the same.

* * * * *